US010197024B2

(12) United States Patent
Tanaka et al.

(10) Patent No.: US 10,197,024 B2
(45) Date of Patent: Feb. 5, 2019

(54) FUEL SUPPLY APPARATUS IN CONSTRUCTION MACHINE

(71) Applicant: Caterpillar SARL, Geneva (CH)

(72) Inventors: Jun Tanaka, Tokyo (JP); Daizo Morita, Tokyo (JP); Atsunori Shimamoto, Tokyo (JP); Atsushi Kawaguchi, Tokyo (JP)

(73) Assignee: Caterpillar SARL, Geneva (CH)

( * ) Notice: Subject to any disclaimer, the term of this patent is extended or adjusted under 35 U.S.C. 154(b) by 0 days.

(21) Appl. No.: 15/526,482

(22) PCT Filed: Nov. 24, 2015

(86) PCT No.: PCT/EP2015/077455
§ 371 (c)(1),
(2) Date: May 12, 2017

(87) PCT Pub. No.: WO2016/083348
PCT Pub. Date: Jun. 2, 2016

(65) Prior Publication Data

US 2017/0314520 A1 Nov. 2, 2017

(30) Foreign Application Priority Data

Nov. 27, 2014 (JP) ..... 2014-239563

(51) Int. Cl.
*F02M 37/00* (2006.01)
*F02M 37/08* (2006.01)
*F02M 37/22* (2006.01)

(52) U.S. Cl.
CPC ..... *F02M 37/08* (2013.01); *F02M 37/0047* (2013.01); *F02M 37/0088* (2013.01); *F02M 37/22* (2013.01); *F02M 2037/228* (2013.01)

(58) Field of Classification Search
CPC .. F02M 37/08; F02M 37/0076; F02M 37/228; B67K 15/03; B67D 7/28; B67D 7/76; B67D 7/00
See application file for complete search history.

(56) References Cited

U.S. PATENT DOCUMENTS

2003/0056824 A1* 3/2003 Harvey ..... F02M 37/0047 137/265
2005/0241622 A1* 11/2005 Dickerson ..... B01D 29/15 123/510

FOREIGN PATENT DOCUMENTS

JP 5-18939 U 3/1993
JP 2005-291636 A 10/2005
(Continued)

OTHER PUBLICATIONS

Machine Translation of JP 2010 070007 A.*

*Primary Examiner* — Hieu T Vo
*Assistant Examiner* — Arnold Castro

(57) ABSTRACT

A fuel supply apparatus able to stop actuating of a fuel supply pump when the fuel supply is stopped or becomes slow, includes a control section which calculates an amount of the fuel in the fuel tank based upon a signal from a fuel gauge, and outputs the result to a fuel meter. The control section also calculates from the fuel gauge signal the amount of the fuel supplied into the fuel tank per unit of time, and if the amount of the fuel supplied per unit of time is determined to be less than a set supply rate, the fuel supply pump is stopped so that a malfunction of the fuel supply can be detected without mounting a special fuel supply sensor.

10 Claims, 4 Drawing Sheets

(56) References Cited

FOREIGN PATENT DOCUMENTS

| | | | |
|---|---|---|---|
| JP | 2007-224568 | A | 9/2007 |
| JP | 2010-070007 | A | 4/2010 |
| JP | 2011-173590 | A | 9/2011 |
| JP | 2011-189886 | A | 9/2011 |
| JP | 2012-096580 | A | 5/2012 |
| WO | 2012/023229 | A1 | 2/2012 |

* cited by examiner

FUEL SUPPLY APPARATUS IN CONSTRUCTION MACHINE

CROSS-REFERENCE TO RELATED APPLICATIONS

This application is a national phase application of International Patent Application No. PCT/EP2015/077455 filed Nov. 24, 2015, which claims priority to Japanese Patent Application No. 2014-239563 filed Nov. 27, 2014, both of which are incorporated by reference herein in their entireties for all purposes.

TECHNICAL FIELD

The present invention relates to the technical field of a fuel supply apparatus in a construction machine such as a hydraulic excavator.

BACKGROUND ART

In general, a construction machine such as a hydraulic excavator may be supplied with fuel directly from a fuel container such as a drum at a working site. In preparation for such a case, a traveling machine body in some such construction machines is equipped with a fuel supply pump (fuel pump or refueling pump). Some of these construction machines configured as follows are known: when a fuel supply pump is used for fuel supply, a sensor in the construction machine detects that the construction machine is full of fuel to allow the fuel supply pump to be automatically stopped (for example, Patent Documents 1 and 2).

At the working site, fuel supply may be performed in an adverse environment where, for example, dust flies around. In view of such a case, a strainer (filter) is provided to prevent foreign matter from being mixed into a fuel tank. However, if the strainer is clogged, fuel supply is delayed, degrading workability. Thus, some of the construction machines configured as follows are known: a sensor in the construction machine detects the pressure in the strainer, and when the detected pressure is equal to or higher than a predetermined value, it is determined that the strainer is clogged and the fuel supply pump is automatically stopped (see, for example, Patent Document 3).

Some other construction machines configured as follows are known: if the fuel container becomes empty during fuel supply and therefore the fuel supply is stopped, then the fuel supply pump runs idly and may be seized; to avoid this, a sensor which detects that fuel supply has been disrupted is provided, and when the sensor issues a signal indicating that fuel supply has been disrupted, the fuel supply pump is automatically stopped (see, for example, Patent Document 4).

Patent Document 1: Japanese Patent Application Laid-open No. 2000-264078

Patent Document 2: Japanese Patent Application Laid-open No. 2005-16332

Patent Document 3: Japanese Patent Application Laid-open No. 2011-173590

Patent Document 4: Japanese Utility Model Application Publication No. H7-13549

However, all of the above-described construction machines use a dedicated sensor for detection to automatically stop the fuel supply pump based on the detection, leading to an increased number of components. Furthermore, the sensor needs to be maintained, disadvantageously degrading workability and increasing costs. These are problems to be solved by the present invention.

DISCLOSURE OF THE INVENTION

In view of these circumstances, the present invention has been created in order to solve the above-described problems. A first aspect of the present invention is a construction machine including a fuel tank, a fuel supply pump for supplying fuel to the fuel tank, a strainer that filters the fuel supplied to the fuel tank, and a control section that calculates a remaining amount of fuel in response to a signal from a fuel gauge measuring the amount of fuel remaining in the fuel tank, and then output the calculated remaining amount data to a fuel meter to allow the fuel meter to display the amount. The control section includes fuel supply determining means for determining whether or not fuel is being fed into the fuel tank when the fuel supply pump is active, and fuel supply pump stopping means for stopping the fuel supply pump when the fuel supply determining means determines that fuel supply has been disrupted.

A second aspect of the present invention is the fuel supply apparatus in the construction machine in the first aspect in which the control section includes fuel supply amount determining means for, when the fuel supply determining means determines that the fuel is being supplied, determining whether or not an amount of the fuel supplied is larger than a preset set supply amount such that, when the fuel supply amount determining means determines that the fuel supply amount is not larger than the set supply amount, the fuel supply pump stopping means stops the fuel supply pump.

A third aspect of the present invention is the fuel supply apparatus in the construction machine in the first or second aspect including notification means, in which the control means includes notification control means for allowing the notification means to give a notification when the fuel supply pump stopping means stops the fuel supply pump.

A fourth aspect of the present invention is the fuel supply apparatus in the construction machine in one of the first to third aspects in which the control section includes timer control means for allowing the fuel supply pump stopping means to stop the fuel supply pump when a fuel supply stoppage condition has lasted for a preset timer time.

In the first aspect of the present invention, if a fuel container becomes empty during fuel supply, which is thus disrupted before completion, the control section, which performs display control on the fuel meter based on an instruction from the fuel gauge, can determine that fuel supply has been disrupted. This enables the need for a dedicated fuel supply sensor to be eliminated.

In the second aspect of the present invention, the control section can determine that the strainer is clogged, allowing the need for a dedicated strainer clog sensor to be eliminated.

In the third aspect of the present invention, the notification by the notification means allows an operator to determine that the fuel supply pump is stopped due to disruption of fuel supply before completion or an insufficient amount of fuel supplied. This improves workability.

In the fourth aspect of the present invention, the fuel supply pump is reliably stopped when fuel supply is disrupted before completion or when an insufficient amount of fuel is supplied.

BEST MODE FOR CARRYING OUT THE INVENTION

Figure 1:
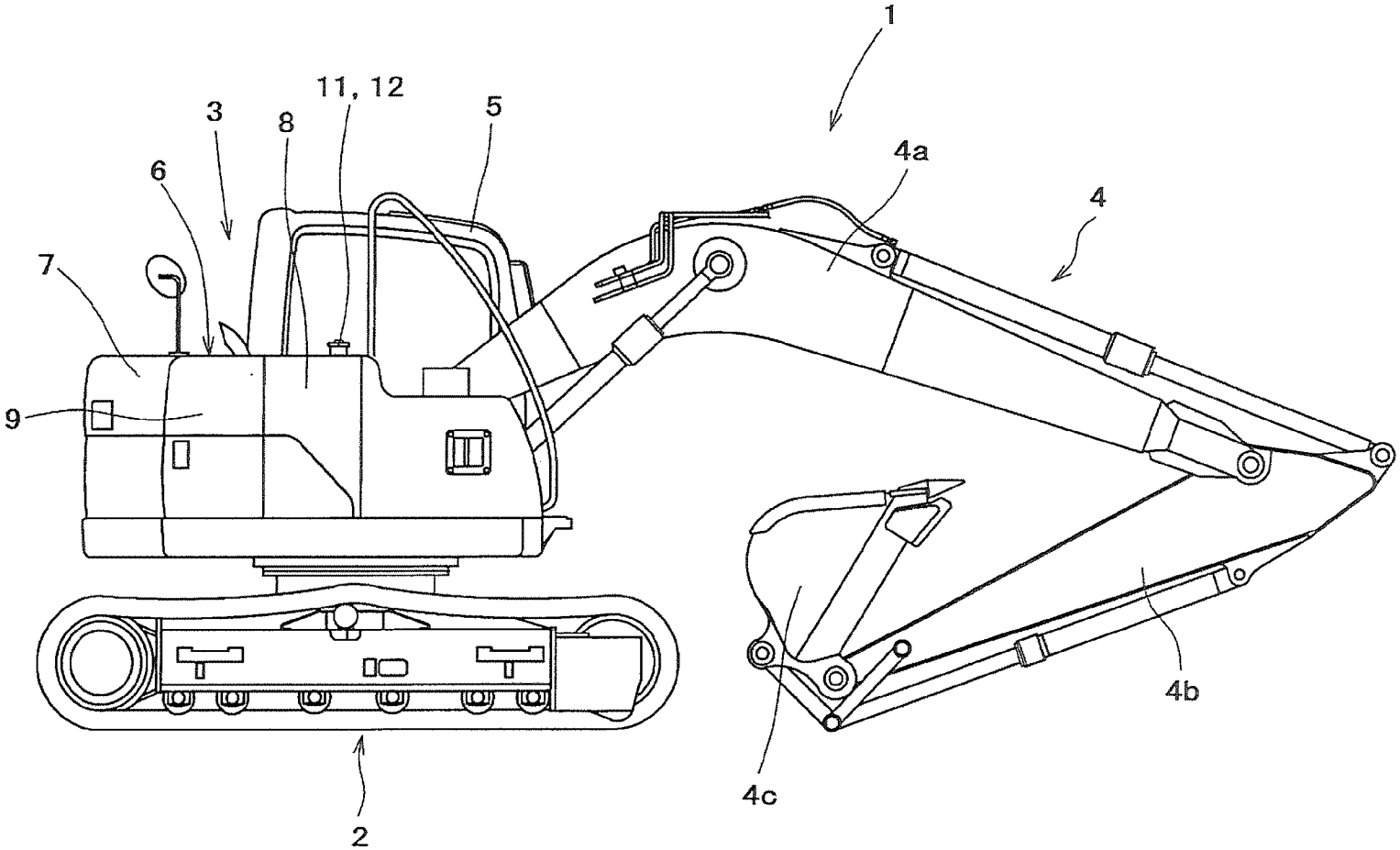
FIG. 1 is a general side view of a hydraulic excavator.
Figure 2:
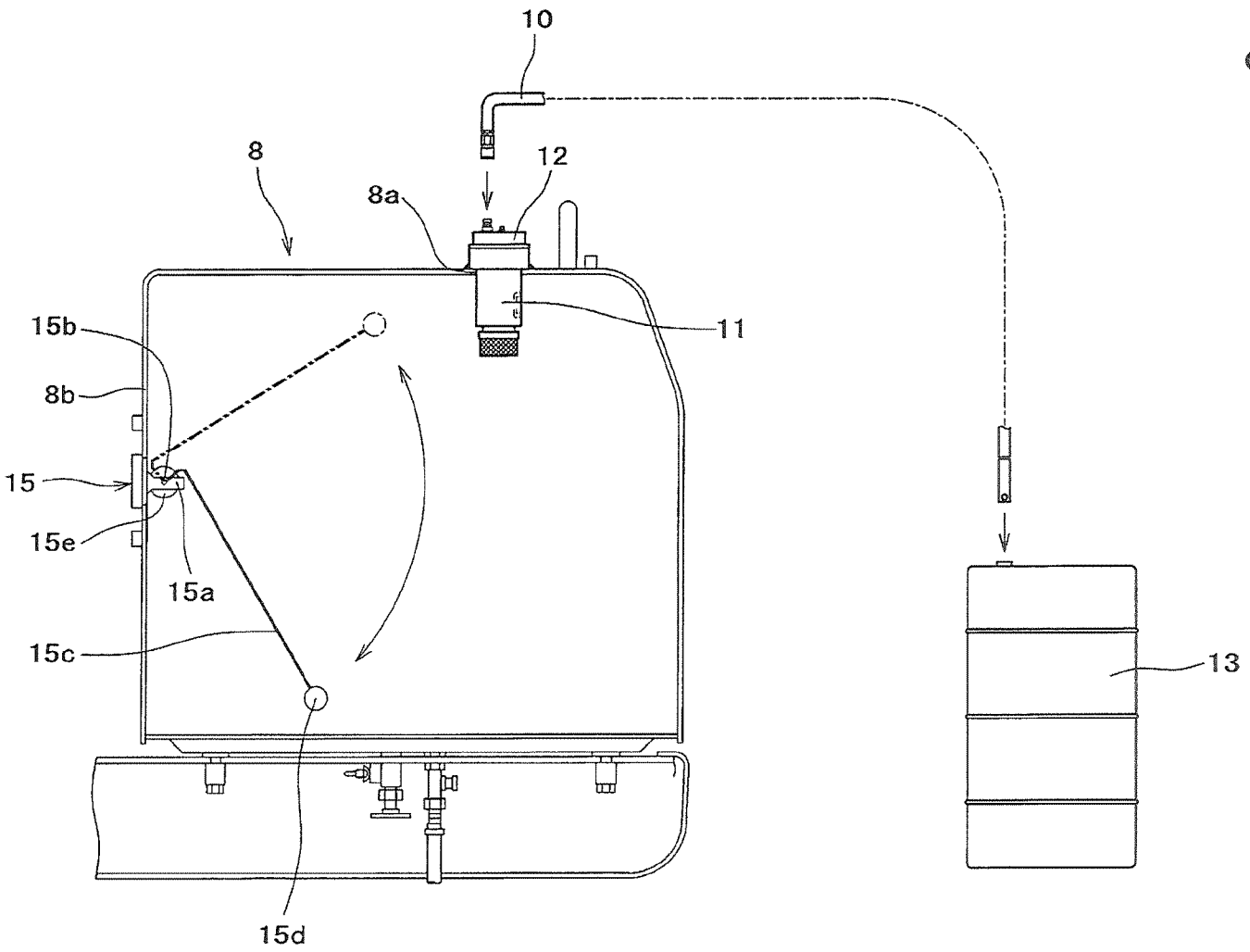
FIG. 2 is a side view of a fuel tank.
Figure 3:
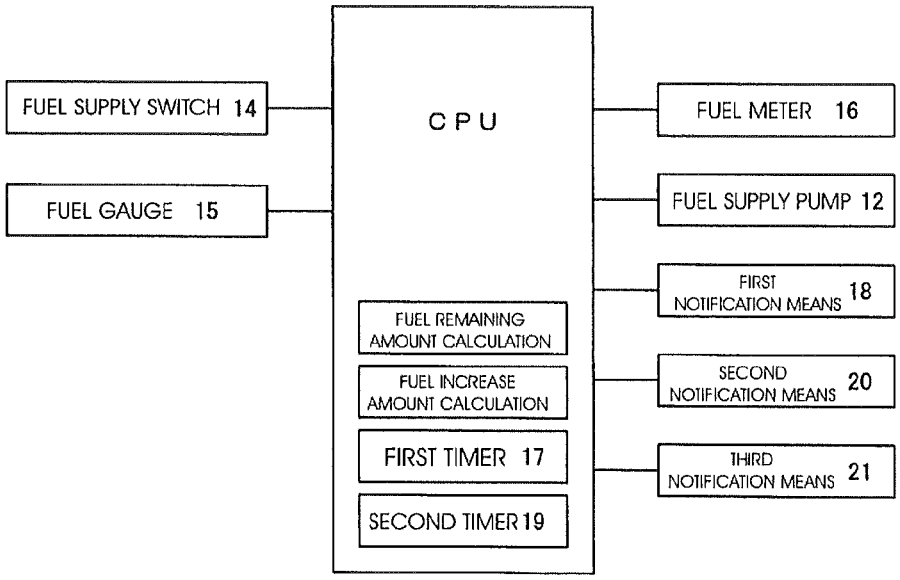
FIG. 3 is a block circuit diagram of a control system.

An embodiment of the present invention will be described based on the drawings. As depicted in the drawings, a hydraulic excavator that is an example construction machine is configured as in the case of the related art. The hydraulic excavator includes a traveling machine body 1. The traveling machine body 1 includes a lower traveling body 2 like a crawler and an upper slewing body 3 mounted on the lower traveling body 2 so as to be able to slew around a vertical axis. The upper slewing body 3 has various member apparatuses such as a front working section 4 with a boom 4*a*, an arm 4*b*, and a bucket 4*c*, an operation room (cab) 5, an engine room 6, a counterweight 7, a fuel tank 8, and a hydraulic oil tank 9.

A hose 10 for fuel supply is connected to a fuel supply port 8*a* of the fuel tank 8. The hose 10 is connected to a supply port of a fuel supply pump 12 integrated with a strainer 11 set in the fuel supply port 8*a*. Fuel is fed into the fuel tank 8 as follows. With a tip of the hose 10 inserted into a fuel container 13 such as a drum, a fuel supply switch 14 provided in the operation room 5 is turned on. This operation signal is input to a control section CPU including a microcomputer. Based on the operation signal, the control section CPU outputs an operation instruction to the fuel supply pump 12. The fuel supply pump 12 is thus actuated to feed the fuel into the fuel tank 8 via the strainer 11. In this case, the fuel supply pump 12 and the strainer 11 may of course be separated from each other instead of being integrated together.

A fuel gauge 15 is provided on a side surface plate 8*b* of the fuel tank 8. A gauge main body 15*a* of the fuel gauge 15 extending into the fuel tank 8 has an arm 15*c* that pivots around a support shaft 15*b* in an up-down direction. Afloat 15*d* is provided at a tip of the arm 15*c*. A potentiometer 15*e* converts, into an electrical signal, a pivoting amount (pivoting angle) by which the arm 15*c* pivots in conjunction with up-down movement of the float 15*d* floating on a surface of the fuel remaining in the fuel tank 8. The signal is input to the control section CPU, which then calculates the amount of the fuel remaining in the fuel tank 8 based on the input electrical signal. The control section CPU outputs a control instruction to a fuel meter 16 to allow the fuel meter 16 to display the result of the calculation.

Figure 4:
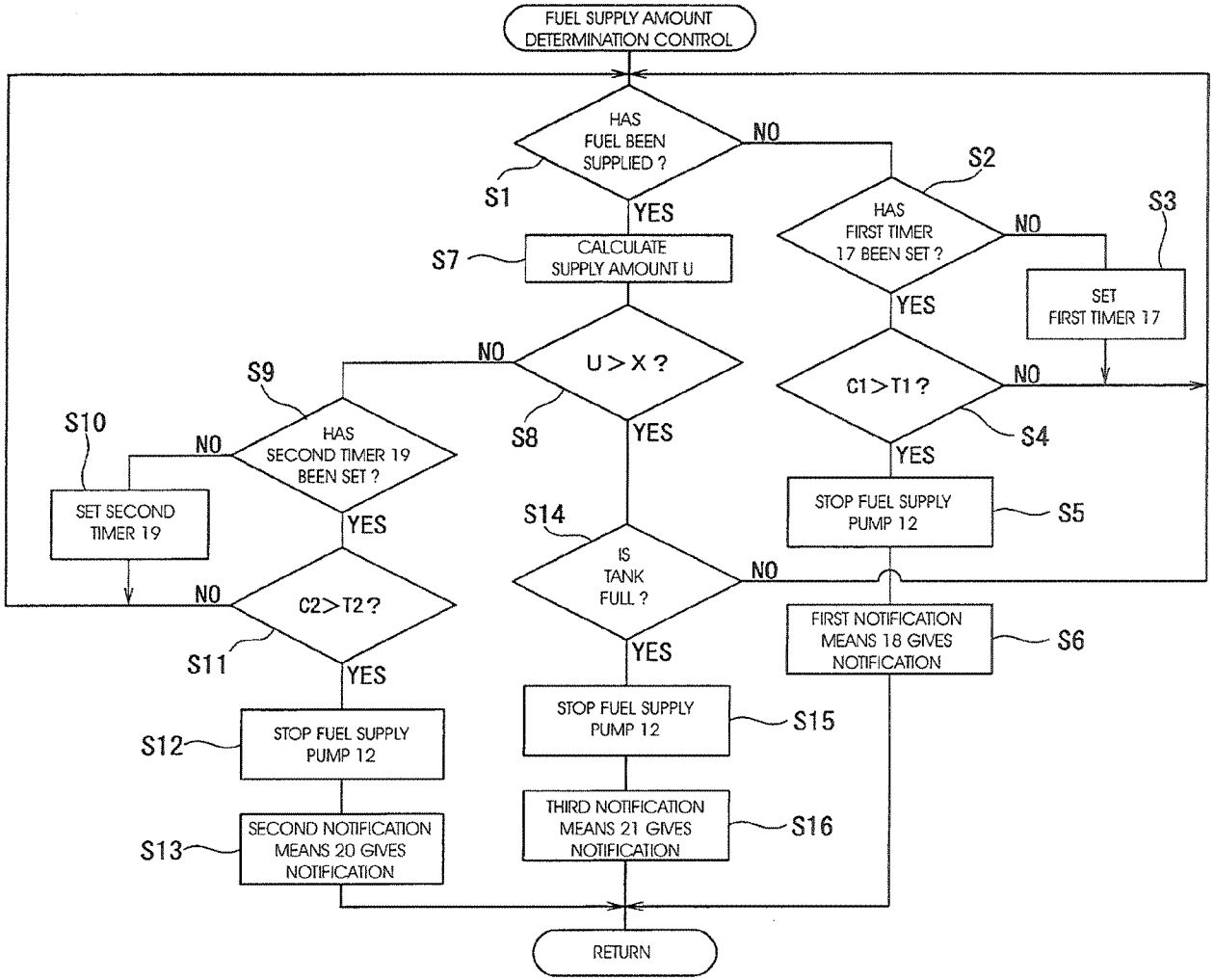
FIG. 4 is a flowchart of the control system.

When the fuel supply switch 14 is turned on, the control section CPU controls determination of a fuel supply amount. A procedure for this determination control will be described below using a flowchart in FIG. 4. As described above, when the fuel supply switch 14 is turned on, a fuel supply amount determination control routine is started. First, the control section CPU determines whether or not fuel has been supplied, in other words, whether or not an electrical signal from the potentiometer 15*e* has changed to a fuel increase side (S1). When the result of the determination is NO, indicating that no fuel has been supplied, whether or not a first timer 17 has been set is determined (S2). When the result of the determination is NO, indicating that the first timer 17 has not been set (the first timer 17 has been reset), the control section CPU sets the first timer 17 (S3) and returns to S1 where whether or not fuel has been supplied is determined. Then, when the control section CPU determines again in S2 that no fuel has been supplied and the determination result in S2 is YES, indicating that the first timer 17 has been set, the control section CPU determines whether or not a count time C1 counted by the first timer 17 exceeds a timer time (for example, five seconds) T1 (C1>T1) (S4). When the determination result is NO, indicating that the count time C1 does not exceed the timer time T1. The control section CPU returns again to determination of whether or not fuel has been supplied in S1. On the other hand, when the determination result in S4 is YES, indicating that the count time C1 exceeds the timer time T1, the control section CPU determines that no fuel has been supplied to output a stoppage instruction to the fuel supply pump 12 (S5), while outputting a notification instruction to first notification means 18 such as a buzzer (S6).

In contrast, when the determination result in S1 is YES, indicating that fuel has been supplied, the control section CPU calculates a supply amount (an increase amount) U per unit time (S7) to determine whether or not the supply amount U is larger than a preset set supply amount X per unit time (U>X?) (S8). When the determination result is NO, indicating that the supply amount U is not larger than the set supply amount X, the control section CPU determines whether or not a second timer 19 has been set (S9). When the determination result is NO, indicating that the second timer 19 has not been set, the control section CPU sets the second timer 19 (S10) and returns to S1 where the control section CPU determines whether or not fuel has been supplied. In contrast, when the determination result in S9 is YES, indicating that the second timer 19 has been set, the control section CPU determines whether a count time C2 counted by the second timer 19 exceeds a preset timer time (for example, 10 seconds) T2 (C2>T2) (S11). When the determination result is NO, indicating that the count time C2 does not exceed the timer time T2, the control section CPU returns to S1 where the control section CPU determines whether or not fuel has been supplied. On the other hand, when the determination result in S11 is YES, indicating that the count time C2 in the second timer 19 exceeds the timer time T2 (C2>T2), the control section CPU determines that the fuel supply amount is smaller than the set supply amount to output the stoppage instruction to the fuel supply pump 12 (S12). The control section CPU also outputs the notification instruction to second notification means 20 (S13).

On the other hand, when the determination result in the above-described S8 is YES, indicating that the fuel supply amount U per unit time is larger than the preset set supply amount X per unit time (U>X), the control section CPU determines whether or not the fuel tank 8 has been filled up (the fuel tank 8 is full) (S14). When the determination result is NO, indicating that the fuel tank 8 is not full, the control section CPU returns again to S1 where the control section CPU determines whether or not fuel has been supplied. When the determination result is YES, indicating that the fuel tank 8 is full, the control section CPU outputs the stoppage instruction to the fuel supply pump 12 (S15), while outputting the notification instruction to third notification means 21 (S16), thus notifying an operator that the fuel supply operation has ended.

The first, second, and third notification means 18, 20, and 21 may be single notification means. The single notification means allows the operator to recognize that the fuel supply pump 12 has been stopped, by varying the contents of the notification according to the situation.

In the embodiment of the present invention configured as described above, if the fuel container 13 becomes empty to disrupt fuel supply started by turning on the fuel supply switch 14, the fuel supply pump 12 is automatically stopped and can thus be prevented from being seized. The automatic stoppage of the fuel supply pump 12 is based on the determination, by the control section CPU, of whether or not fuel has been supplied based on the signal from the fuel gauge 15, which monitors the amount of fuel remaining in the fuel tank 8. This eliminates the need for a dedicated sensor that monitors fuel supply. As a result, the number of components can be reduced, and the maintenance of the sensor is not needed.

Furthermore, in the embodiment, when the fuel supply amount is determined to be excessively small during fuel supply, the strainer 11 is determined to be clogged, and this is determined to be abnormal. Then the fuel supply pump is automatically stopped. As a result, measures for dealing with the clogged strainer 11 can be immediately taken to improve workability. Determination of whether or not the strainer 11 is clogged is made based on calculation by the control section CPU, which makes determination for the case where fuel supply has been disrupted. This eliminates the need for a dedicated sensor that detects the clog, thus reducing the number of components and enhancing maintainability.

Moreover, if such abnormalities occur, the first and second sensors 18 and 20 give notifications to the operator to allow the operator to immediately recognize that fuel supply has been abnormal.

Furthermore, determination of whether or not fuel supply has been abnormal is made when the preset timer time is exceeded. As a result, possible malfunction can be prevented when an abnormality signal is input due to noise or the like.

INDUSTRIAL APPLICABILITY

The present invention can be utilized in the field of a fuel supply apparatus in a construction machine such as a hydraulic excavator.

The invention claimed is:

1. A fuel supply apparatus for a construction machine including a fuel tank and a fuel level sensor for detecting a level of fuel within the fuel tank, the fuel supply apparatus comprising:

a fuel supply pump for transferring fuel from an external fuel container to the fuel tank;

a strainer disposed fluidly in series with the fuel supply pump to filter the fuel transferred to the fuel tank; and a controller in communication with the fuel supply pump, the controller being configured to:

receive an initiation signal from a fuel transfer switch and energize the fuel supply pump to transfer the fuel from the external fuel container to the fuel tank based on the initiation signal from the fuel transfer switch, receive a signal from the fuel level sensor that is indicative of the level of fuel within the fuel tank, determine whether any fuel has been transferred from the external fuel container to the fuel tank based on the signal from the fuel level sensor, start a first timer in response to a determination that no fuel has been transferred from the external fuel container to the fuel tank, compare a count value of the first timer to a first threshold value, and deenergize the fuel supply pump in response to the count value of the first timer exceeding the first threshold value.

2. The fuel supply apparatus according to claim 1, wherein the controller is further configured to:

determine a rate of fuel level change per unit time based on the signal from the fuel level sensor, compare the rate of fuel level change per unit time to a threshold rate, and start a second timer in response to the rate of fuel level change per unit time not being greater than the threshold rate, compare a count value of the second timer to a second threshold value, and deenergize the fuel supply pump in response to the count value of the second timer exceeding the second threshold value.

3. The fuel supply apparatus according to claim 1, further comprising notification means, wherein the controller is further configured to transmit a notification instruction to said notification means to give a notification in response to the controller deenergizing the fuel supply pump.

4. The fuel supply apparatus of claim 2, wherein the controller is further configured to:

determine whether the fuel tank is full based on the signal from the fuel level sensor, and deenergize the fuel supply pump in response to a determination that the fuel tank is full.

5. A fuel supply apparatus for a construction machine including a fuel tank and a fuel level sensor for detecting a level of fuel within the fuel tank, the fuel supply apparatus comprising:

a fuel supply pump for transferring fuel from an external fuel container to the fuel tank;

a strainer disposed fluidly in series with the fuel supply pump to filter the fuel transferred to the fuel tank; and a controller operatively coupled to the fuel supply pump, the controller being configured to:

receive an initiation signal from a fuel transfer switch and energize the fuel supply pump to transfer the fuel from the external fuel container to the fuel tank based on the initiation signal from the fuel transfer switch, receive a signal from the fuel level sensor that is indicative of the level of fuel within the fuel tank, determine a rate of fuel level change per unit time based on the signal from the fuel level sensor, compare the rate of fuel level change per unit time to a threshold rate, and start a timer in response to the rate of fuel level change per unit time not being greater than the threshold rate, compare a count value of the timer to a threshold value, and deenergize the fuel supply pump in response to the count value of the timer exceeding the threshold value.

6. The fuel supply apparatus of claim 5, wherein the controller is further configured to:

determine whether the fuel tank is full based on the signal from the fuel level sensor, and deenergize the fuel supply pump in response to a determination that the fuel tank is full.

7. A construction machine, comprising:

a fuel tank;

a fuel level sensor for detecting a level of fuel within the fuel tank;

a fuel supply pump fluidly coupled to the fuel tank for transferring fuel from an external fuel container to the fuel tank;

a strainer disposed fluidly in series with the fuel supply pump to filter the fuel transferred to the fuel tank; and a controller in communication with the fuel supply pump and the fuel level sensor, the controller being configured to:

receive an initiation signal from a fuel transfer switch and energize the fuel supply pump to transfer the fuel from the external fuel container to the fuel tank based on the initiation signal from the fuel transfer switch, receive a signal from the fuel level sensor that is indicative of the level of fuel within the fuel tank, determine whether any fuel has been transferred from the external fuel container to the fuel tank based on the signal from the fuel level sensor, start a first timer in response to a determination that no fuel has been transferred from the external fuel container to the fuel tank, compare a count value of the first timer to a first threshold value, and deenergize the fuel supply pump in response to the count value of the first timer exceeding the first threshold value.

8. The construction machine according to claim 7, wherein the controller is further configured to:

determine a rate of fuel level change per unit time based on the signal from the fuel level sensor, compare the rate of fuel level change per unit time to a threshold rate, and start a second timer in response to the rate of fuel level change per unit time not being greater than the threshold rate, compare a count value of the second timer to a second threshold value, and deenergize the fuel supply pump in response to the count value of the second timer exceeding the second threshold value.

9. The construction machine according to claim 7, further comprising notification means, wherein the controller is further configured to transmit a notification instruction to said notification means to give a notification in response to the controller deenergizing the fuel supply pump.

10. The construction machine of claim 8, wherein the controller is further configured to:

determine whether the fuel tank is full based on the signal from the fuel level sensor, and deenergize the fuel supply pump in response to a determination that the fuel tank is full.

* * * * *